US008128205B2

(12) United States Patent
Benjamin et al.

(10) Patent No.: US 8,128,205 B2
(45) Date of Patent: Mar. 6, 2012

(54) FLUID EJECTION DEVICE

(75) Inventors: Trudy Benjamin, Portland, OR (US); Kevin Bruce, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1169 days.

(21) Appl. No.: 11/975,928

(22) Filed: Oct. 23, 2007

(65) Prior Publication Data

US 2008/0055366 A1 Mar. 6, 2008

Related U.S. Application Data

(63) Continuation-in-part of application No. 11/263,733, filed on Oct. 31, 2005, now Pat. No. 7,648,227.

(51) Int. Cl.
*B41J 2/05* (2006.01)

(52) U.S. Cl. ..... 347/57; 347/58; 347/59; 347/9

(58) Field of Classification Search ..... 347/57–59, 347/12, 13, 9

See application file for complete search history.

(56) References Cited

U.S. PATENT DOCUMENTS

| | | | | |
|---|---|---|---|---|
| 5,300,968 | A * | 4/1994 | Hawkins | 347/12 |
| 5,745,131 | A | 4/1998 | Kneezel et al. | |
| 5,790,140 | A | 8/1998 | Koizumi et al. | |
| 6,027,198 | A | 2/2000 | Tanaka et al. | |
| 6,033,051 | A | 3/2000 | Kaneko | |
| 6,069,710 | A | 5/2000 | Lee | |
| 6,102,510 | A * | 8/2000 | Kikuta et al. | 347/9 |
| 6,130,692 | A * | 10/2000 | Mochizuki et al. | 347/57 |
| 6,386,666 | B1 | 5/2002 | Takamura et al. | |
| 6,439,697 | B1 | 8/2002 | Axtell et al. | |
| 6,540,333 | B2 * | 4/2003 | Axtell et al. | 347/57 |
| 6,729,708 | B2 | 5/2004 | Fujii | |
| 7,090,321 | B2 | 8/2006 | Koyama | |
| 7,101,007 | B2 | 9/2006 | Hayasaki | |
| 7,126,715 | B2 | 10/2006 | Nakayama et al. | |
| 7,195,328 | B2 | 3/2007 | Silverbrook et al. | |
| 2002/0163549 | A1 | 11/2002 | Anderson et al. | |
| 2003/0107611 | A1 | 6/2003 | Kim | |
| 2004/0046830 | A1 | 3/2004 | Mitsuzawa | |

(Continued)

FOREIGN PATENT DOCUMENTS

JP 09-254387 9/1997

OTHER PUBLICATIONS

International Search Report for Application No. PCT/US2008/080278. Report issued Jun. 25, 2009.

*Primary Examiner* — Matthew Luu
*Assistant Examiner* — Henok Legesse

(57) ABSTRACT

A fluid ejection device includes a plurality of firing cells, a clocked latch switch, and a data latch switch. Each firing cell includes a heater used to fire ink through a nozzle, a drive switch, and a memory cell used to store a control value used to control the drive switch. The memory cell includes a data switch. A clocked latch switch receives a data-in signal and latches the data-in signal. All of the firing cells in the plurality of firing cells use the data-in signal latched by the clocked latch switch. The data latch switch latches the data-in signal to the data switch of at least two, but not all of the firing cells in the plurality of firing cells.

13 Claims, 3 Drawing Sheets

U.S. PATENT DOCUMENTS

2004/0080554 A1 4/2004 Kim
2004/0212660 A1* 10/2004 Axtell et al. ..... 347/57
2005/0116975 A1 6/2005 Kasai
2005/0134620 A1* 6/2005 Hirayama et al. ..... 347/9
2005/0140703 A1 6/2005 Ou et al.
2006/0139380 A1 6/2006 Walmsley et al.
2006/0197806 A1 9/2006 Komatsu
2007/0097178 A1 5/2007 Benjamin et al.
2007/0115313 A1 5/2007 Silverbrook et al.
2007/0153039 A1 7/2007 Silverbrook et al.
2007/0176964 A1 8/2007 Silverbrook et al.

* cited by examiner

CONTROL
78
SELECT
73
PRECHARGE
74
FIRE
75
50
52
57
54
70
53
DATA CLOCK
72
71
DATA IN
81
82
51
55
56
58
59
70
70
70
76
77
62
67
64
70
63
61
65
66
68
69
70
70
70
TO ADDITIONAL CELLS AND CELL BLOCKS
60
TO ADDITIONAL CELLS

FLUID EJECTION DEVICE

CROSS REFERENCE TO RELATED APPLICATION

This application is a continuation-in-part of application Ser. No. 11/263,733, filed Oct. 31, 2005 now U.S. Pat. No. 7,648,227, which is hereby incorporated by reference.

BACKGROUND

An inkjet printing system may include one or more printheads that eject ink drops through a plurality of orifices or nozzles. The nozzles are typically arranged in one or more arrays, such that properly sequenced ejection of ink from the nozzles causes characters or other images to be printed on print medium.

In a thermal inkjet printing system, the printhead ejects ink drops through nozzles by rapidly heating small volumes of ink located in vaporization chambers. The ink is heated with small electric heaters, such as thin film resistors also referred to as firing resistors. Heating the ink causes the ink to vaporize and be ejected through the nozzles.

One way printing speed and quality has been increased in inkjet printheads is by the increase of nozzles per printhead. However, as the number of nozzles per printhead increases, it is a challenge to efficiently provide electronic signals to appropriately coordinate the firing of nozzles at the appropriate time.

DESCRIPTION OF THE EMBODIMENT

Figure 1:
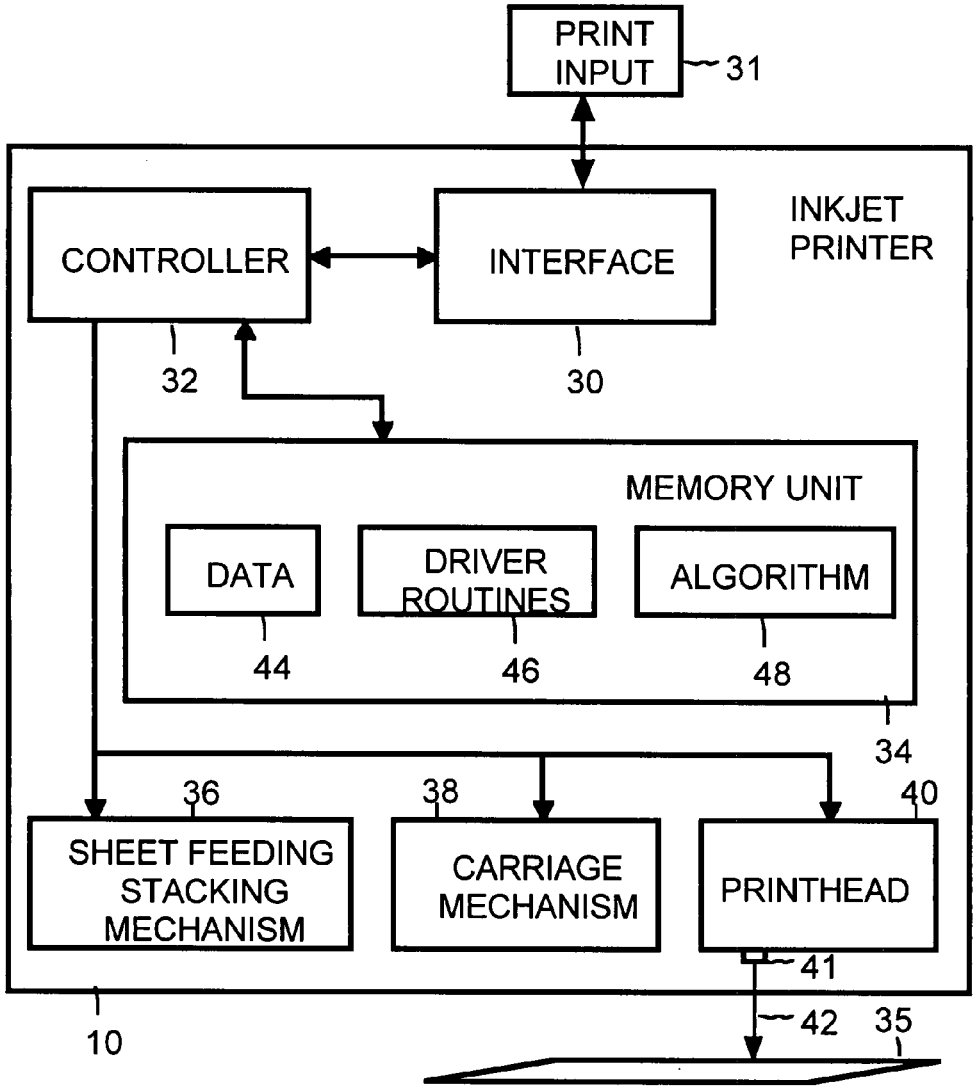
FIG. 1 is a simplified block diagram of an embodiment of an inkjet printer.

FIG. 1 is a simplified block diagram of an inkjet printer 10. Inkjet printer 10 includes, for example, a controller 32 that, via an interface unit 30, receives print input 31 from a computer system or some other device, such as a scanner or fax machine. The interface unit 30 facilitates the transferring of data and command signals to controller 32 for printing purposes. Interface unit 30 also enables inkjet printer 10 to download print image information to be printed on a print medium 35.

In order to store the data, at least temporarily, inkjet printer 10 includes a memory unit 34. For example, memory unit 34 is divided into a plurality of storage areas that facilitate printer operations. The storage areas include a data storage area 44, driver routines storage 46, and algorithm storage area 48 that holds the algorithms that facilitate the mechanical control implementation of the various mechanical mechanisms of inkjet printer 10.

Data area 44 receives data files that define the individual pixel values that are to be printed to form a desired object or textual image on medium 35. Driver routines 46 contain printer driver routines. Algorithms 48 include the routines that control a sheet feeding stacking mechanism for moving a medium through the printer from a supply or feed tray to an output tray and the routines that control a carriage mechanism that causes a printhead carriage unit to be moved across a print medium on a guide rod. Alternatively, in printers where printhead location is fixed, such as in printers that use a page-wide printhead array, no carriage mechanism is needed.

In operation, inkjet printer 10 responds to commands by printing full color or black print images on print medium 35. In addition to interacting with memory unit 34, controller 32 controls a sheet feeding stacking mechanism 36 and a carriage mechanism 38. Controller 32 also forwards firing data to one or more fluid ejection devices, represented in FIG. 1 by a fluid ejection device 40. For example, fluid ejection device is a printhead or some other entity capable of ejecting fluid such as ink. The input data 31 received at interface 30 includes, for example, information describing printed characters and/or images for printing. For example, input data may be in a printer format language such as Postscript, PCL 3, PCL 5, HPGL, HPGL 2 or some related version of these. Alternatively, the input data may be formatted as raster data or formatted in some other printer language. The firing data sent to fluid ejection device 40 is used to control the ejection elements associated with the nozzles of an ink jet printer, such as for thermal ink jet printer, piezo ink jet printers or other types of ink jet printers. This is represented in FIG. 1 by ink 42 being ejected from a nozzle 41.

Figure 2:
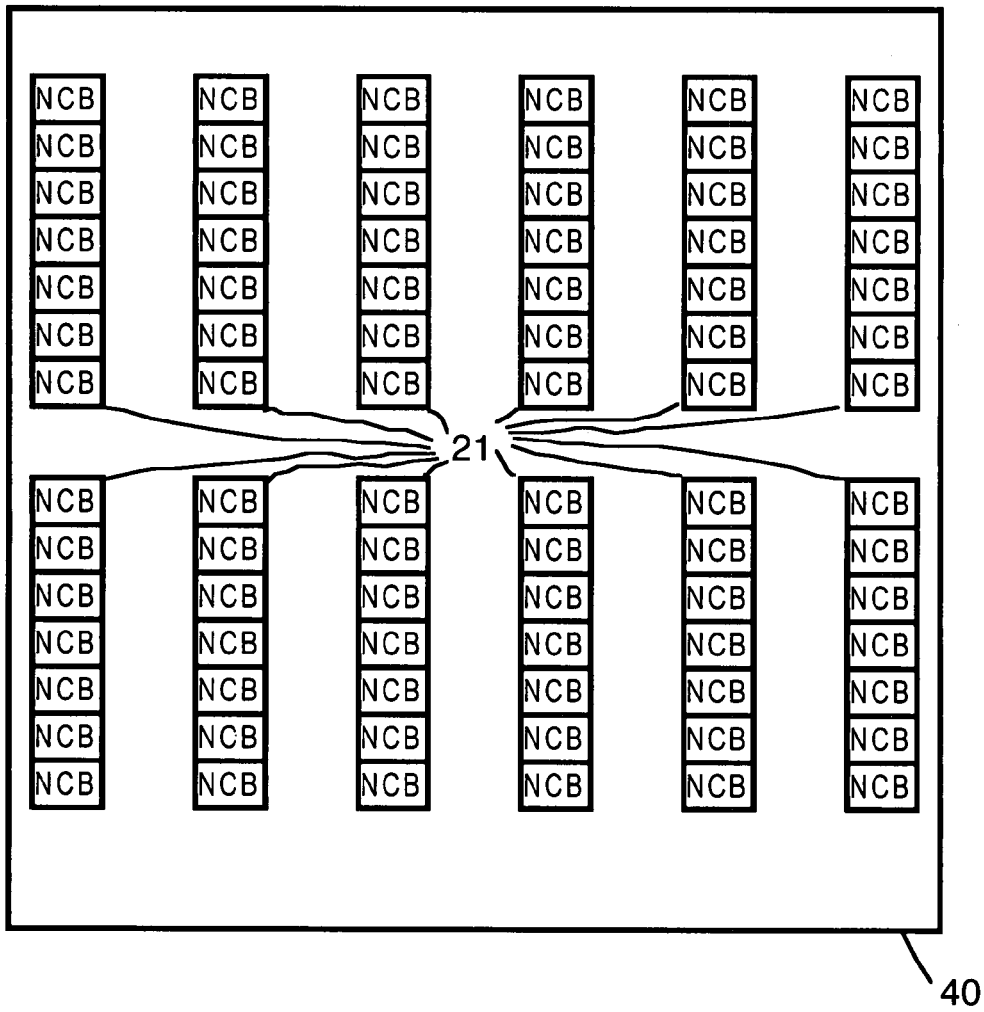
FIG. 2 is a simplified illustration showing an embodiment of a fluid ejection device, such as a printhead, including a plurality of nozzle cell blocks.

FIG. 2 is a simplified block diagram, not to scale, that shows fluid ejection device 40 having many nozzle cell blocks (NCB) 21. Each nozzle cell block 21 includes a plurality of nozzles and associated supporting entities such as vaporization chambers, ink feed trenches memory cell and electronics used to facilitate firing ink through each nozzle. The number of nozzle cell blocks per fluid ejection device and the number of nozzles per nozzle cell block vary dependent upon the design constraints of the particular fluid ejection device. For example, a fluid ejection device that includes 1248 nozzles may contain 84 nozzle cell blocks with an average of 14 or 15 nozzles per nozzle cell block. For more information on nozzles and associated supporting entities such as vaporization chambers, ink feed trenches memory cell and electronics used to facilitate firing ink through each nozzle, see, for example USPAP Number 2007/0097178 A1, published on May 3, 2007 by Benjamin et al., for FLUID EJECTION DEVICE WITH DATA SIGNAL LATCH CIRCUITRY.

Figure 3:
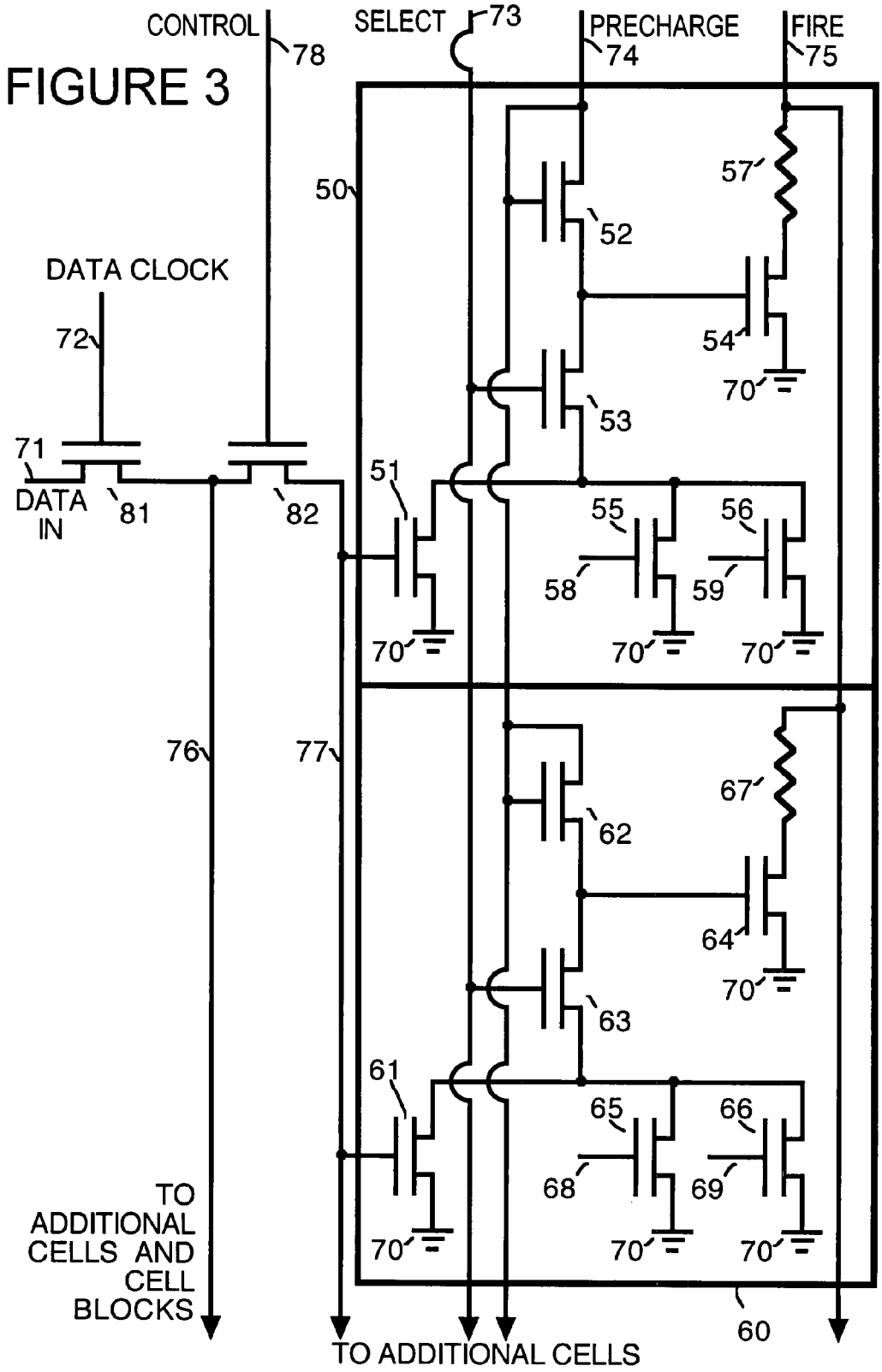
FIG. 3 is a schematic diagram for an embodiment of firing electronics associated with a plurality of nozzle cells sharing a latched data node.

FIG. 3 is a schematic diagram of electronics associated with a plurality of nozzle cells sharing a latched data node. A firing cell 50 is part of a first nozzle cell and a firing cell 60 is part of a second nozzle cell on fluid ejection device 40.

Before reaching firing cell 50 and firing cell 60, a data-in signal on line 71 is clocked through a clocked latch switch 81 by a data clock signal on a data clock line 72. The resulting latched data signal on a data line 76 is additionally latched by a data latch transistor 82 that includes a drain-source path electrically coupled between data line 76 and a shared data line 77. Shared data line 77 functions as a shared latch data node for both firing cell 50 and firing cell 60. In some embodiments, some or all of the data can bypass clocked latch switch 81. For example, half the data can travel through clocked latch switch 81 and the other half of the data can be placed directly onto data line 76 (or the equivalent) bypassing clocked latch switch 81.

While FIG. 3 shows just firing cell 50 and firing cell 60, attached to shared data line 77, shared data line 77 can serve as a shared latch data node for additional firing cell, as illustrated by the arrows at the bottom of FIG. 3. Likewise, data line 76 is also connected to additional firing cells and cell blocks.

The gate of data latch switch 82 is electrically coupled to a control line 78. Control line 78 can be electrically connected to (i.e., receive the same signal as) a pre-charge line 74.

Pre-charge line 74 receives a pre-charge signal for pre-charge cell 50. In another embodiment, control line 78 is connected to a different signal line than pre-charge line 74. For example, control line 78 can be connected to a pre-charge line used to fire other firing cells, or to another available signal line on fluid ejection device 40 that provides an appropriately timed pulsed signal.

Data latch switch 82 passes data from data line 76 to shared data line 77 via a high level pre-charge signal on control line 78. The data is latched onto the latched data line 76 as the pre-charge signal transitions from a high level to a low level. The data-in signal on line 71 and the latched data signal on data line 76 are active when low.

In one embodiment, the data latch switch 82 is a minimum sized transistor to minimize charge sharing between the shared data line 77 and the gate to source node of data latch switch 82 as the pre-charge signal (or other pulsed signal) on control line 78 transitions from a high voltage level to a low voltage level. This charge sharing reduces high voltage level latched data. Also, in one embodiment, the drain of the data latch switch 82 determines the capacitance seen at data line 76 when the pre-charge signal is at a low voltage level and a minimum sized transistor keeps this capacitance low.

As shown in FIG. 3, multiple firing cells use the same data and share the same data latch switch 82 and the latched data signal on shared data line 77. The latched data signal on shared data line 77 is latched once and used by the multiple firing cells. This increases the capacitance on any individual shared data line 77 making it less susceptible to electrical disturbances resulting from switching and reduces the total capacitance driven via data line 76.

For, example, a separate capacitance placed at data line 77 used to store latched data is typically not used since data line 77 is connected to multiple firing cells. The multiple firing cells provide the needed capacitance to store latched data and to protect performance from electrical disturbances. Thus, connecting multiple firing cells to data line 77 reduces the amount of space used to implement the firing cells.

Firing cell 50 includes a drive switch 54, a firing resistor 57, a pre-charge transistor 52, a select transistor 53, a first address transistor 55, a second address transistor 56 and a data switch 51 connected to each other and to a ground line 70 as shown. Address lines 58 and 59 are used to determine in what address cycle firing cell 50 is to be fired.

Similarly, a firing cell 50 includes a drive switch 64, a firing resistor 67, a pre-charge transistor 62, a select transistor 63, a first address transistor 65, a second address transistor 66 and a data transistor 61 connected to each other and to a ground line 70 as shown. Address lines 68 and 69 are used to determine in what address cycle firing cell 60 is to be fired.

Data switch 51 and data transistor 61 are large enough to fully discharge the gate of drive switch 54 and drive switch 64, respectively, before the beginning of an energy pulse in a fire signal placed on a fire line 75.

The operation of firing cell 50 and firing cell 60 are similar. Therefore, for exemplary purposes, just the operation of firing cell 50 is described.

For firing cell 50, the data-in signal is latched first to data line 76 and passed to shared data line 77 via data latch switch 82 by providing a high level voltage pulse on control line 78. For example, the high level voltage pulse is approximately 14 to 16 volts. This compares with a maximum voltage for data clock 72 is approximately 12 to 16 volts. Also, storage node capacitance at the gate of drive switch 54 is pre-charged through a pre-charge transistor 52 via a high level voltage pulse on pre-charge line 74. When pre-charge line 74 is connected to control line 78, data latch switch 82 is turned off to provide latched data signals as the voltage pulse on control line 78 transitions from the high voltage level to a low level voltage. The data to be latched into data line 77 is provided while the pre-charge signal is at a high voltage level and held until after the pre-charge signal transitions to a low voltage level. The data for data line 76 is held until data clock 72 transitions to a low level, which happens before the high voltage pulse on control line 78 transitions to a low level.

When pre-charge line 74 is not connected to control line 78, the data-in signal received by data line 76 is passed to shared data line 77 via data latch switch 82 by providing a high level voltage pulse on control line 78. Data latch switch 82 is turned off to provide the latched data signals as the voltage pulse on the control line 78 transitions from a high voltage level to a low level voltage. The gate of drive switch 54 is pre-charged through pre-charge transistor 52 via the high level voltage pulse on pre-charge line 74. The high voltage pulse on pre-charge line 74 occurs after the transition of control line 78 from a high voltage level to a low voltage level.

In one embodiment of pre-charge firing cell 50, after the high level voltage pulse on pre-charge line 74, address signals on address lines 58 and 59 are used to set the states of first address transistor 55 and second address transistor 56. A high level voltage pulse is provided on select line 73 to turn on select transistor 53 and capacitance at the gate of drive switch 54 discharges if data switch 51, first address transistor 55 and/or second address transistor 56 is on. Alternatively, the capacitance at the gate of drive switch 54 remains charged if data switch 51, first address transistor 55 and second address transistor 56 are all off. In this way, data switch 51, first address transistor 55 and second address transistor 56 act as a memory cell to hold a control value (either a charged signal or an uncharged signal) used to control drive switch 54 when select transistor 53 is turned on. The value on drive switch 54 is set when select transistor 53 is turned on, and then held when select transistor 53 is turned of, until precharged again. When first address transistor 55 and second address transistor 56 are turned off, data switch 51 determines the control value stored in the memory cell based on the latched data signal on shared data line 77.

Firing cell 50 is an addressed firing cell if both address signals on first address transistor 55 and second address transistor 56 are low, and the capacitance at the gate of drive switch 54 either discharges if the latched data signal at shared data line 77 is high or remains charged if latched data signal at latched data line 7 is low. Firing cell 50 is not an addressed firing cell if at least one of the address signals on first address transistor 55 or second address transistor 56 is high, and the capacitance at the gate of drive switch 54 discharges regardless of the voltage level of latched data signal at shared data line 77. The first and second address transistors 55 and 56 comprise an address decoder and, if firing cell 50 is addressed, data switch 51 controls the voltage level on the capacitance at the gate of drive switch 54

During a firing cycle, when firing cell 50 is addressed and drive switch 54 is turned on, a firing pulse is applied to firing resistor 57 which then acts as a heater that vaporizes ink in a vaporization chamber and ejects the ink through a nozzle toward media 35 (shown in FIG. 1).

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

We claim:

1. A fluid ejection device comprising:

a plurality of firing cells, each firing cell including:

a heater used to fire ink through a nozzle, a drive switch, connected to the heater, and a memory cell used to store a control value used to control the drive switch, the memory cell including a data switch;

a clocked latch switch, the clocked latch switch receiving a data-in signal and latching the data-in signal, wherein all of the firing cells in the plurality of firing cells use the data-in signal latched by the clocked latch switch; and, a data latch switch, the data latch switch simultaneously latching the data-in signal to the data switch of at least two of the firing cells in the plurality of firing cells, but not latching the data-in signal to all of the firing cells in the plurality of firing cells.

2. A fluid ejection device as in claim 1 wherein for each firing cell in the plurality of firing cells the memory cell additionally includes a plurality of address transistors connected to address lines, the address lines being used to determine in what address cycle the firing cell is to be fired.

3. A fluid ejection device as in claim 1 wherein each firing cell in the plurality of firing cells additionally comprises a select switch used to select the firing cell, wherein the control value used to control the drive switch when the select switch is turned on.

4. A fluid ejection device as in claim 1 wherein the clocked latch switch has a gate connected to a clock signal, the clocked latch switch receiving the data-in signal and latching the data-in signal in response to the clock signal.

5. A fluid ejection device as in claim 1 wherein for each firing cell in the plurality of firing cells, the drive switch, when turned on, allows current flow through the heater.

6. A fluid ejection device as in claim 1 wherein for each firing cell in the plurality of firing cells, the heater is a drive resistor.

7. A fluid ejection device as in claim 1 wherein the data switch has a gate and the data latch switch latches the data-in signal to the gate of the data switch of each firing cell in the at least two, but not all of the firing cells in the plurality of firing cells.

8. A fluid ejection device as in claim 1:

wherein the clocked latch switch has a gate connected to a clock signal, the clocked latch switch receiving the data-in signal and latching the data-in signal in response to the clock signal;

wherein the data switch has a gate and the data latch switch latches the data-in signal to the gate of the data switch of each firing cell in the at least two, but not all of the firing cells in the plurality of firing cells;

wherein each firing cell in the plurality of firing cells additionally comprises a select switch used to select the firing cell, wherein the control value used to control the drive switch when the select switch is turned on; and, wherein for each firing cell in the plurality of firing cells the memory cell additionally includes a plurality of address transistors connected to address lines, the address lines being used to determine in what address cycle the firing cell is to be fired.

9. A method for providing a control value to a plurality of firing cells of a fluid ejection device, comprising:

receiving and latching a data-in signal by a clocked latch switch, wherein all of the firing cells in the plurality of firing cells receive the data-in signal latched by the clocked latch switch;

simultaneously latching the data-in signal into memory cells within at least two of the firing cells in the plurality of firing cells, but not latching the data-in signal into all of the firing cells in the plurality of firing cells; and, using the data-in signal latched to the memory cells to control firing ink from a nozzle in the fluid ejection device.

10. A fluid ejection device comprising:

a plurality of firing means for firing ink through a nozzle, each of the plurality of firing means including:

storing means for storing a control value used to determine in which firing cycle ink is fired through nozzles;

first latch means for receiving a data-in signal and latching the data-in signal, wherein all of the firing means in the plurality of firing means use the data-in signal latched by the first latch means; and, second latch means for simultaneously latching the data-in signal to the storing means within at least two of the firing cells in the plurality of firing means, but not latching the data-in signal to the storing means within all of the firing means in the plurality of firing means.

11. A fluid ejection device as in claim 10 wherein for each firing means in the plurality of firing means the storing means additionally includes address means for determining in what address cycle the firing means is to be fired.

12. A fluid ejection device as in claim 10 wherein each firing means in the plurality of firing means additionally comprises select means for selecting the firing means so that the control value can be used to determine in which firing cycle ink is fired through nozzles.

13. A fluid ejection device as in claim 10 wherein the first latch means includes a means for receiving a clock signal, the clock signal controlling when the first latch means receives the data-in signal and latches the data-in signal.

* * * * *

UNITED STATES PATENT AND TRADEMARK OFFICE

CERTIFICATE OF CORRECTION

PATENT NO. : 8,128,205 B2
APPLICATION NO. : 11/975928
DATED : March 6, 2012
INVENTOR(S) : Trudy Benjamin et al.

It is certified that error appears in the above-identified patent and that said Letters Patent is hereby corrected as shown below:

In column 6, line 36, in Claim 10, delete “cells” and insert -- means --, therefor.

Signed and Sealed this
Eleventh Day of December, 2012

David J. Kappos

David J. Kappos
*Director of the United States Patent and Trademark Office*